US009496669B2

(12) United States Patent
Pichler

(10) Patent No.: US 9,496,669 B2
(45) Date of Patent: Nov. 15, 2016

(54) SLIDING CONTACT ARRANGEMENT FOR AN EROSION ARRANGEMENT AND METHOD FOR PRODUCING A SLIDING CONTACT ARRANGEMENT

(71) Applicant: Walter Maschinenbau GMBH, Tuebingen (DE)

(72) Inventor: Bernhard Pichler, Zuchwil (CH)

(73) Assignee: WALTER MASCHINENBAU GMBH, Tuebingen (DE)

( * ) Notice: Subject to any disclaimer, the term of this patent is extended or adjusted under 35 U.S.C. 154(b) by 174 days.

(21) Appl. No.: 14/347,813

(22) PCT Filed: Sep. 25, 2012

(86) PCT No.: PCT/EP2012/068816
§ 371 (c)(1),
(2) Date: Mar. 27, 2014

(87) PCT Pub. No.: WO2013/045415
PCT Pub. Date: Apr. 4, 2013

(65) Prior Publication Data

US 2014/0235074 A1 Aug. 21, 2014

(30) Foreign Application Priority Data

Sep. 27, 2011 (DE) ..... 10 2011 053 979

(51) Int. Cl.
*H01R 39/00* (2006.01)
*H01R 39/08* (2006.01)
(Continued)

(52) U.S. Cl.
CPC ..... *H01R 39/08* (2013.01); *H01R 13/025* (2013.01); *H01R 39/24* (2013.01); *H01R 39/56* (2013.01);
(Continued)

(58) Field of Classification Search
USPC ..... 439/13, 23–25
See application file for complete search history.

(56) References Cited

U.S. PATENT DOCUMENTS 2,269,614 A * 1/1942 Von Soden ..... H01R 39/24 310/228
3,886,386 A 5/1975 Hillig
(Continued)

FOREIGN PATENT DOCUMENTS

DE 202004014936 U1 1/2005
DE 102005013106 A1 9/2006
JP 55065416 A 5/1980

OTHER PUBLICATIONS

International Search Report of PCT/EP2012/068816 dated Nov. 11, 2012.
(Continued)

*Primary Examiner* — Tho D Ta
(74) *Attorney, Agent, or Firm* — Fitch, Even, Tabin & Flannery LLP

(57) ABSTRACT

A sliding contact arrangement (13) is used in an erosion arrangement (10) or an erosion machine. The sliding contact arrangement (13) establishes an electrical connection with a slip ring (14), whereby said slip ring can be driven about a rotational axis (D), and with a current source or voltage source (11). The sliding contact arrangement (13) has an electrical connecting line (12) that can be electrically connected to the current source or voltage source (11). The connecting line (12) is mechanically and electrically connected to an electrically conductive body (20). On an underside (21) associated with the slip ring (14), the body (20) includes a plurality of projecting contact wires (35) bundled into several strands. In not loaded, not bent state, the strands (37) extend parallel to each other away from the
(Continued)

Figure 1:
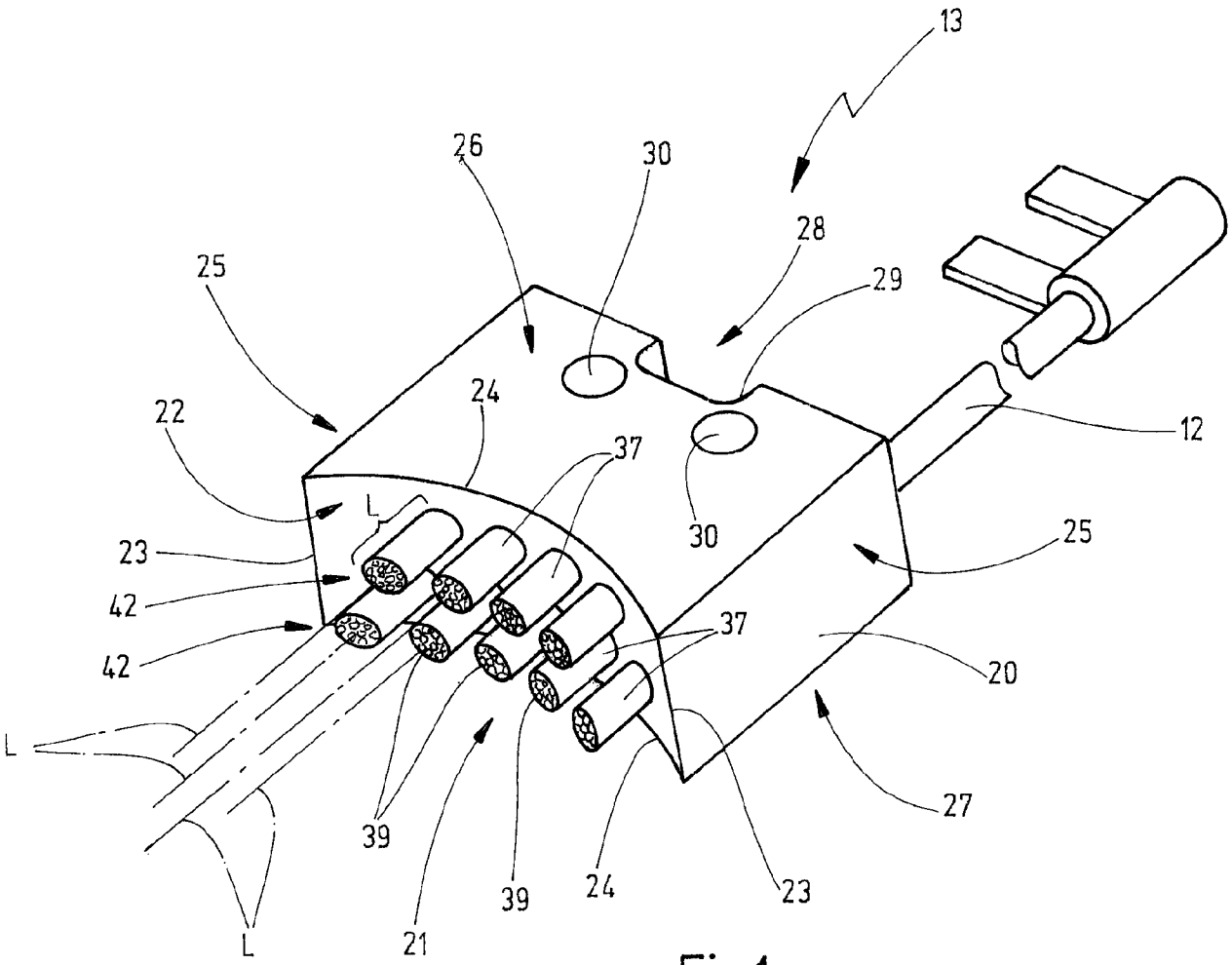

Fig.2 underside (21) toward their free ends (39), which contact a common generated surface of a cylinder.

5 Claims, 2 Drawing Sheets

(51) Int. Cl.

| | |
|---|---|
| ***H01R 13/02*** | (2006.01) |
| ***H01R 39/24*** | (2006.01) |
| ***H01R 39/56*** | (2006.01) |
| ***H01R 43/12*** | (2006.01) |
| *H01R 43/24* | (2006.01) |

(52) U.S. Cl.
CPC ..... *H01R 43/12* (2013.01); *H01R 43/24* (2013.01); *Y10T 29/49117* (2015.01)

(56) References Cited

U.S. PATENT DOCUMENTS

| | | | | |
|---|---|---|---|---|
| 4,347,456 | A | 8/1982 | Chabrerie | |
| 4,358,699 | A | 11/1982 | Wilsdorf | |
| 4,398,113 | A | 8/1983 | Lewis et al. | |
| 4,415,635 | A * | 11/1983 | Wilsdorf | H01R 39/24 310/248 |
| 4,579,611 | A * | 4/1986 | Broady | H01R 39/36 156/284 |
| 5,177,529 | A * | 1/1993 | Schroll | G03G 15/80 310/249 |
| 5,633,700 | A * | 5/1997 | Peck | G01R 29/12 324/457 |
| 6,071,125 | A * | 6/2000 | Shiozawa | H01R 39/24 310/242 |
| 6,245,440 | B1 * | 6/2001 | Kuhlmann-Wilsdorf | H01R 39/22 29/826 |
| 7,179,090 | B1 * | 2/2007 | Lynch | H01R 39/24 310/239 |
| 7,287,985 | B2 * | 10/2007 | Butler | H01R 39/38 439/13 |

OTHER PUBLICATIONS

Chinese office action in corresponding Chinese Application No. 201280046837.7, issued Nov. 3, 2015, 14 pages.
Second Chinese office action and search report in corresponding Chinese Application No. 201280046837.9, issued Jun. 20, 2016, 11 pages.

* cited by examiner

SLIDING CONTACT ARRANGEMENT FOR AN EROSION ARRANGEMENT AND METHOD FOR PRODUCING A SLIDING CONTACT ARRANGEMENT

CROSS REFERENCE TO RELATED APPLICATIONS

This patent application is the national phase of PCT/EP2012/068816 filed Sep. 25, 2012, which claims the benefit of German Patent Application No. DE 102011053979.4 filed Sep. 27, 2011, each of which is incorporated by reference as if fully re-written herein.

TECHNICAL FIELD

The present invention relates to a sliding contact arrangement for an erosion arrangement or an erosion machine, as well as to a method for producing the sliding contact arrangement.

BACKGROUND

The sliding contact arrangement is disposed to produce an electrical connection between an electrical connecting line and a slip ring on the spindle, said slip ring rotating during the operation of the erosion arrangement. The spindle has a tool receptacle that is electrically coupled with the slip ring. In doing so, a current transfer from a voltage source or current source can be accomplished—via the connecting line, the sliding contact arrangement and the slip ring—to the erosion tool that can be driven in a rotating manner.

In electric motors or for current transfer, sliding contact arrangements of this type represent a part that rotates about a rotational axis, said part being embodied as a carbon brush. Such a carbon brush has been known from DE 10 2005 013 106 A1 and is used, for example in washing machine motors. The carbon brush is configured as a multi-layer carbon brush.

As a rule, carbon brushes are pressed by means of an appropriate carbon brush holder with a mechanically and/or pneumatically generated spring force against the rotating slip ring in order to prevent the carbon brush from being lifted off the slip ring. For example, DE 20 2004 014 936 U1 discloses a carbon brush holder.

It has been found, however, that the carbon brushes used until now are not suitable for the current transfer in machine tools and, in particular, in erosion machines. Machine breakdowns and machine down-times occur again and again, because there is no longer a sufficient current transfer by the carbon brushes to the rotating spindle. Considering, in particular, erosion machines such as rotary erosion machines, the sliding contact arrangement is subjected not only to a mechanical load. The sliding contact arrangement and the erosion arrangement in accordance with the invention are intended for use in combined erosion and grinding machines. Considering these, there is the problem that the fluid used for cooling during the grinding operation is used, at the same time, as the dielectric fluid during the erosion process, and thus the fluid may contain grinding particles such as particles of the workpiece that is being machined. Despite purification devices such as filters it is not possible to remove all contaminants from the fluid. The dielectric fluid used for erosion, shavings and the like may enter between the sliding contact arrangement and the slip ring and impair proper contacting. Erosion damage on the slip ring or on the sliding contact arrangement is a frequent occurrence during operation.

In searching for a remedy, two paths have been taken so far. On the one hand, in electrical rotary erosion machines, the electrical connection between the current source or voltage source and the erosion tool was implemented by a line that extends along the rotational axis inside the spindle. There, it is possible to implement the sliding contact connections that do not come into contact with the dielectric medium, shavings or other contaminants. On the other hand, it has been suggested to protect the slip ring and the sliding contact arrangement against the entry of fluids, shavings or the like. However, the encapsulation required therefor is complex and expensive.

In both cases, it is necessary to retrofit erosion machines that are currently commercially available; however, due to machine features, this is at times not possible at all.

SUMMARY

Therefore, the object of the present invention may be viewed as being the provision of a sliding contact arrangement for an erosion arrangement or an erosion machine and, in particular a rotary erosion machine that is subject to minimal wear and allows a largely failure-free operation of the erosion machine.

This object is achieved with a sliding contact arrangement displaying the features of Patent claim 1 in accordance with the invention. The sliding contact arrangement is intended and disposed to establish an electrical connection between an electrical connecting line, on the one hand, and a slip ring of a spindle, said slip ring being drivable in a turning or rotating manner, on the other hand. To accomplish this, the sliding contact arrangement comprises an electrically conductive body that—in a preferred exemplary embodiment—is made of metal and, in particular, of steel. The connecting line is electrically and mechanical connected to the body. For example, the body may be provided with a hole or a recess into which one end of the connecting line is inserted or pressed. Preferably, a material-bonded connection is formed by soldering or by so-called tamping. The connecting line is embodied as a copper wire strand.

From an underside of the body associated with the slip ring, a plurality of electrically conductive contact wires extend, respectively, away from said underside and toward their free ends. In the region of the free end, the contact wires abut against the slip ring when the sliding contact arrangement is in operative position, so that an electrical connection is established between the slip ring and the connecting line via the body and the electrically conductive contact wires.

It has been found that, with the use of a sliding contact arrangement in accordance with the invention, no or only negligible changes due to erosion occur in the region of the sliding contact arrangement of the slip ring of the erosion machine. Even if fluids or dirt particles were to penetrate, the plurality of contact wires establishing the electrical contact ensure a sufficient, conductive cross-section for conduction of the current from the connecting line into the sliding ring. A spark formation between the contact wires and the slip ring is avoided. The contact wires projecting from the underside of the body are flexible in a direction transverse to their direction of extensions and are, in particular, flexible in the direction of rotation of the slip ring. Due to this flexibility, there also results a limiting of the force with which the contact wires abut against the slip ring, so that the mechanical wear is limited as well.

In a preferred exemplary embodiment, the free length of the contact wires from the underside of the body to their respective free ends is 2 to 9 mm, whereby the length may change in the stated range depending on wear. The contact wire may have a diameter between 0.05 mm and 0.25 mm. Preferably, the free length of the contact wires is at least ten times greater than their diameter.

In a preferred exemplary embodiment, the contact wires form several strands that extend from the underside of the body. Consequently, the contact wires are bundled into several strands. The contact wires of a strand may be woven, twisted, braided, stranded or, in the simplest case, bundled, so as to be arranged next to each other. Preferably, the distance between adjacent strands on the underside of the body is smaller than the free length of the contact wires.

In a preferred exemplary embodiment, the body has open recesses applied to the underside, for example, by drilling. Alternatively, the body may also be a cast part or an injection-molded part, in which case the recesses are provided when the body is being manufactured. In particular, each of these recesses is used to electrically and mechanically connect, respectively, one strand with the body. To accomplish this, a material-boded connection may be provided, for example, by soldering and, in particular, by gluing. The glue is electrically conductive and contains silver particles, for example. It is also possible to tamp in the strands. When tamping is used, a powder of electrically conductive particles, for example a silver powder, is liquefied at high pressure and penetrates into the small spaces between the contact wires of the strand as well as between the contact wires and the inside wall of the recess of the body. By reducing the pressure, this liquid solidifies and an electrically conductive, material-bonded, connection is the result.

Preferably, the underside of the body is concavely arched. Preferably, the curvature extends along a circular arc. The radius of this circular arc preferably corresponds to the distance of the underside of the body from the rotational axis of the spindle when the sliding contact arrangement is in operative position. It is also possible for the underside to have plane sections or be totally plane.

Considering one possible method of production, the strands and/or the connecting line are placed in a mold and the body is subsequently molded in the form of a cast component. The mechanical and electrical connection between the strands and the body, on the one hand, and between the connecting line and the body, on the other hand, is thus established while the body is being cast. This manufacturing option is particularly efficient and cost-effective.

Figure 2:
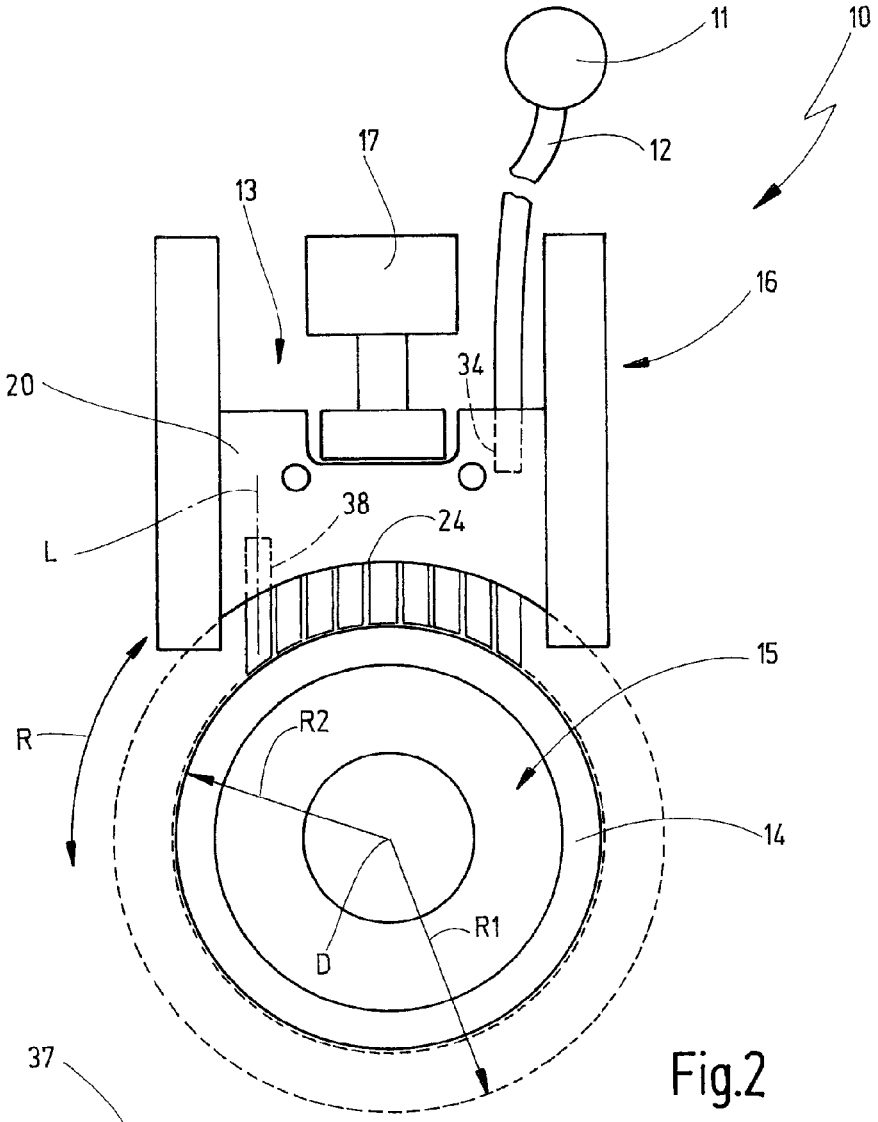
Figure 3:
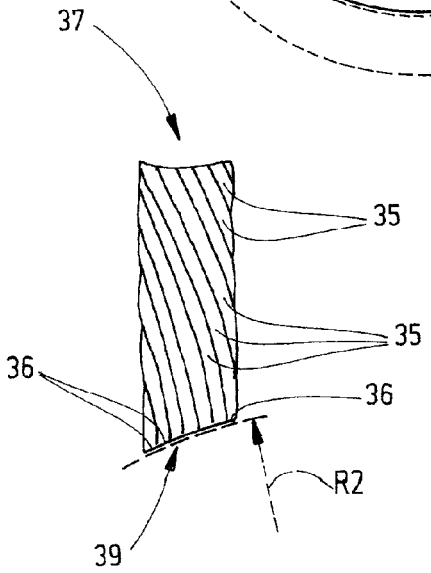

Additional advantages of the invention result from the dependent patent claims as well as from the description. The description explains the invention with the use of exemplary embodiments. The description is restricted to essential features of the invention as well as to other given facts. The drawings are to be used for supplementary reference. They show in FIG. 1 a perspective representation of an exemplary embodiment of a sliding contact arrangement;

FIG. 2 a schematic representation, resembling a block circuit diagram, of an erosion arrangement; and FIG. 3 an enlarged schematic representation of a strand of the sliding contact arrangement in accordance with FIG. 1.

FIG. 2 shows an erosion arrangement 10 of a not specifically illustrated erosion machine or combined grinding and erosion machine. The erosion arrangement 10 comprises a current source or voltage source 11 that is electrically connected via an electrical connecting line 12 to a sliding contact arrangement 13. The sliding contact arrangement 13 is disposed to establish an electrical contact between the connecting line 12 and the current source or current source 11, on the one hand, and a slip ring 14 of an erosion spindle 15, on the other hand. The slip ring 14 is non-torsionally arranged on the erosion spindle 15 and is electrically conductive. Said slip ring is electrically connected to a not illustrated tool receptacle of the erosion spindle 15. An electrical connection between the slip ring 14 and an erosion tool held in the tool receptacle can be established via the tool receptacle. While the erosion machine is being operated, the erosion tool and thus the erosion spindle 15 rotate about the rotational axis D that extends at a right angle with respect to the plane of projection in FIG. 2.

The sliding contact arrangement 13 is arranged in a holder 16 of the erosion arrangement 10 and held so as to be shiftable radially with respect to the rotational axis D. With the use of an adjustment means 17, the sliding contact arrangement 13 can be shifted radially with respect to the rotational axis D and can thus be moved toward the slip ring 14 or away from the slip ring 14. With a prespecified force, the adjustment means 17 can press the sliding contact arrangement 13 against the slip ring 14. The force may be generated mechanically and/or pneumatically. It is also possible to analyze the current flowing through the sliding contact arrangement 13 and to activate the adjustment means 17 as a function of the result of this analysis. For example, if due to a mechanical wear, the electrical resistance between the sliding contact arrangement 13 and the slip ring 14 increases, the sliding contact arrangement 31 can be radially moved toward the slip ring 14 by way of the adjustment means in order to improve the electrical contact. When the current flowing through the sliding contact arrangement 13 is analyzed, it is also possible to use the current or the voltage of the current source or voltage source 11 as the reference value.

FIG. 1 shows an exemplary embodiment of the sliding contact arrangement 13.

The sliding contact arrangement 13 comprises a body 20 that is made of a cohesive material without seams or joints. Referring to the exemplary embodiment, the body 20 consists of metal, in particular steel. Said body may also be produced as a cast element of a pourable material. It is also possible to make the body of an electrically conductive plastic material, for example, by the addition of electrically conductive particles to a matrix of plastic material. Additives that can be used are carbon particles or metallic particles of silver, gold or copper. Materials used for the matrix of plastic material are polyethylene, polyurethane or another suitable plastic material. For example, it is also possible to use doped polyacetylene, doped trans-poylyacetylene, doped polypyrrole or the like in the production of the body 20.

The body 20 has a curved underside 21. The underside 21 consists of a concavely arched surface 22. The surface 22 is limited by two parallel straight lateral edges 23 that are connected to each other by way of two curved longitudinal edges 24 that also extend parallel to each other. The longitudinal edges 24 extend along a circular arc having a first radius R1. Consequently, the surface 24 forms a part of the generated surface of a cylinder.

On each of the two lateral edges 23 there is an adjoining lateral surface 25 of the body. In the exemplary embodiment, the two lateral surfaces 25 are oriented parallel to each other.

Between the two lateral surfaces 25, adjoining the one longitudinal edge 24, there is a front surface 26 and, adjoining the respectively other longitudinal edge 24, there is a rear surface 27. On the upper side 28 opposite the underside 21, the body 20 has a recess 29 into which engages the adjustment means 17 for shifting the body 20. In addition, the body 20 has at least one mounting hole 30 so that the body 20 can be detachably mounted to a mounting plate of the holder 16. In the exemplary embodiment, two mounting holes 20 pass completely through the body 20, i.e., from the front surface 26 through to the rear surface 27.

The connecting point between the connecting line 12 and the body 20 is provided in the region of the upper side 28 next to the recess 29. As is obvious from FIG. 2, the body 20 is provided at that point with a connecting recess 34 that is open toward the upper side 28. The connecting line 12 is inserted into the connecting recess 34 and electrically and mechanically connected to the body 20. The material-bonded connection can be established with the aid of an electrically conductive connecting means such as, for example, an electrically conductive glue, or by soldering with solder tin.

Another possibility is to mount the connecting line 12 in the connecting recess 34 in a material-bonded manner by so-called tamping. In the case of tamping, a metal powder, for example silver powder, is liquefied with the use of high pressure. By reducing the pressure, this conductive fluid solidifies and creates a material-bonded connection between the body 20 and the connecting line 12. Also in this case, an electrical and a mechanical connection are achieved at the same time.

A plurality of contact wires 35 project from the underside 21 and from the surface 22 and extend toward their free ends 36. The contact wires 35 are electrically conductive and, preferably, consist of copper or a copper-containing alloy. The contact wires 35 are not uniformly distributed over the surface 22 on the underside 21 of the body 20. Rather, the contact wires 35 are bundled in strands 37 in the exemplary embodiment. Each strand 37 comprises several contact wires 35, for example, ten to twenty contact wires 35. In the exemplary embodiment, the sliding contact arrangement 13 comprises nine strands 37. The number of strands 37 may vary. Preferably, between five and fifteen strands are arranged on the body 20.

The contact wires 35 my extend parallel next to each other and extend essentially in a straight manner away from the underside 21 of the body 20. Referring to the exemplary embodiment of FIG. 3, the contact wires 35 are twisted to form a strand 37. It is also possible for spun, braided or woven contact wires to form a strand 37.

In the exemplary embodiment, the electrical and mechanical connection of the strands 37 with the body 20 is accomplished analogously to the connection of the connecting line 12 with the body 20. Recesses 38 that are open to the underside 21 are provided from the underside 21 in the body 20, only one recess 38 of said recesses being shown in FIG. 2 for the sake of clarity. Each of the strands 37 is inserted in a recess 38 and connected there preferably in a material-bonded manner to the body 20, as has been described in conjunction with the connecting line 12. The strands 37 may also be tamped in or soldered in, for example. Considering another preferred production of the sliding contact arrangement 13, the connecting line 12 and/or the stands 37 are placed in a casting mold for the body 20, and the body 20 is subsequently cast. When the body 20 is being cast, the electrical and mechanical connection with the connecting line 12 and/or the strands 37 is established at the same time.

The free length L of a strand 37 is measured starting at the surface 22 of the underside 21 to the free end 39 of the strand 37 associated with the slip ring 14. The free end 39 of a strand 37 is prespecified by the position of the free ends 36 of the contact wires 35 forming the strand 37. The free length L of the strands 37 is essentially identical. Referring to the exemplary embodiment described herein, the free length L of the strands 37 is between two and six millimeters. A free length L in the range of four millimeters has been found to be advantageous in view of the flexibility and flexural rigidity of a strand L. In the region of the strands 37 outside the body 20, the contact wires are not connected to each other by a connecting means, in particular not connected to each other in a material-bonded manner. As a result of this, the strand 37 is sufficiently resilient and not rigid, both in its extension direction transverse to the rotational axis D and also in the direction of rotation R about the rotational axis D. Too rigid an embodiment of the strand 37 would cause strong wear on the slip ring 14.

In the exemplary embodiment, the strands 37 are arranged in several and, as in the example, in two rows 42. The rows 42 are arranged corresponding to the direction of rotation R of the spindle 15 and consequently extend approximately parallel to the longitudinal edges 24 of the body 20. The number of strands 37 per row 42 may be identical or different. In the exemplary embodiment, the distance between two adjacent strands 37 of a common row 42 is the same for all rows 42. In doing so, the distance of the strands 37 is measured at the orifice of the recess 38 and thus within the region of the surface 22 and, therefore, corresponds to the distance of the relevant recesses 38. Preferably, the strands 37 of a row 42 are arranged so as to be offset with respect to the strands 37 of the respectively other row 42, in the direction of rotation R about the rotational axis D. When looking at the front surface 26 of the body 20, this means that the strands 37 of the one row 42 are arranged in the region of the gap between two strands 37 of the other row 42.

In the exemplary embodiment, the distance between two adjacent strands 37 is smaller than the free length L of the strands 37. Preferably, the distance between two adjacent strands 37 is at least half the size of the diameter of a strand 37 or the diameter of the recess 38. Therefore, the mean density of the contact wires 35 at the surface 22 of the underside 21 is sufficiently large. Nevertheless, there is sufficient free space between adjacent strands in order to allow a deformation or deflection of the strands 37 in a direction transverse to their direction of extension. In the exemplary embodiment, the direction of extension of the strands is defined by the longitudinal axes L of the recesses 38. The longitudinal axes L of the recesses 38 are arranged so as to be parallel to each other.

It is also possible to use other arrangement modifications of the strands 37 on the underside 21 of the body 20. It is possible to implement both regular and also irregular arrangements of the strands 37.

Referring to the exemplary embodiment preferred herein, the free ends 39 of the strands 37 are adapted to the generated surface of a cylinder having a second radius R2 about the rotational axis D. As a result of this, a uniform and the best-possible planar contact of the strands 37 with the slip ring 14 is ensured. In doing so, the second radius R2 preferably corresponds to the radius of the slip ring 14 as has only been illustrated in FIG. 2. The second radius R2 is smaller than the first radius R1.

The invention relates to a sliding contact arrangement 13 that is intended and disposed for use in an erosion arrangement 10 or an erosion machine. The sliding contact arrangement 13 establishes an electrical connection with a slip ring 14, whereby said slip ring can be driven about a rotational axis D, and with a current source or voltage source 11. To accomplish this, the sliding contact arrangement 13 comprises an electrical connecting line 12 that can be electrically connected to the current source or voltage source 11. In addition, the connecting line 12 is mechanically and electrically connected to an electrically conductive body 20. On an underside 21 associated with the slip ring 14, the body 20 comprises a plurality of projecting contact wires 35. The contact wires 35 consist of electrically conductive material. Preferably, the contact wires 35 are bundled into several strands 39. In not loaded, not bent state, the strands 37 extend parallel to each other away from the underside 21 of the body toward their respectively free end 39. The free ends 39 of the strands 37 contact a common generated surface of a cylinder, the radius of said generated surface preferably corresponding to the radius of the slip ring.

LIST OF REFERENCE SIGNS

10 Erosion arrangement
11 Current source or voltage source
12 Connecting line
13 Sliding contact arrangement
14 Slip ring
16 Holder
17 Adjustment means
20 Body
21 Underside
22 Surface
23 Lateral edge
24 Longitudinal edge
25 Lateral surface
26 Front surface
27 Rear surface
28 Upper side
29 Indentation
30 Mounting hole
34 Connecting recess
35 Contact wire
36 Free end of the contact wire
37 Wire strand
38 Recess
39 Free end of the strand
42 Row
D Rotational axis
L Free length of the strand
R Direction of rotation
R1 First radius
R2 Second radius

The invention claimed is:

1. A sliding contact arrangement (13) apparatus for an erosion arrangement (10) for establishing an electrical connection with the use of a drivable and electrically conductive slip ring (14), the apparatus comprising:

an electrically conductive body (20), an electrical connecting line (12) that is electrically connected to the body (20) and to a voltage or current source (11), a holder (16) in which the body (20) is held at a radial distance from a spindle (15) that can be driven about a rotational axis (D), a plurality of electrically conductive contact wires (35) that are electrically and mechanically connected to the body (20) and form several wire strands (37), said wire strands extending from an underside (21) of the body (20) associated with the slip ring (14), respectively toward their individual free ends (36), which are arranged to correspond to and engage a circumferential surface of a cylinder corresponding to the electrically conductive slip ring (14), which is electrically connected to a tool receptacle provided on the spindle (15), said tool receptacle being disposed for mounting an erosion tool, the circumferential surface having a radius around the rotational axis, and wherein adjacent wire strands (37) are separated by a distance that is smaller than a free length of the contact wires (35) from the underside (21) of the body (20) to their respective free ends (36), the free length being between 2 and 9 millimeters, wherein individual ones of the wire strands (37) are fastened in individual recesses (38) of the body (20), and wherein the recesses (38) are arranged in parallel alignment with each other.

2. The sliding contact arrangement (13) apparatus as in claim 1, wherein the wire strands (37) are mechanically and electrically connected by material-bonded connection to the body (20) in the recesses (38).

3. The sliding contact arrangement (13) apparatus as in claim 1, wherein the underside (21) of the body (20) forms a concavely arched surface (22).

4. The sliding contact arrangement (13) apparatus as in claim 1, wherein the wire strands are arranged with a distance between any two of the wire strands of at least half of a diameter of an individual one of the wire strands.

5. The sliding contact arrangement (13) apparatus as in claim 1, wherein individual ones of the wire strands comprise at least five of the contact wires that are twisted, spun, braided, or woven together to form a given one of the wire strands.

* * * * *